US005513666A

United States Patent [19]

Fujiwara

[11] Patent Number: 5,513,666

[45] Date of Patent: May 7, 1996

[54] METHOD OF CLEANING WORKS AND CLEANING APPARATUS

[75] Inventor: Katsuya Fujiwara, Akashi, Japan

[73] Assignee: Mitsubishi Jidosha Kogyo Kabushiki Kaisha, Tokyo, Japan

[21] Appl. No.: 282,578

[22] Filed: Jul. 29, 1994

[30] Foreign Application Priority Data

Jul. 30, 1993 [JP] Japan ..... 5-190113
Jul. 30, 1993 [JP] Japan ..... 5-190114

[51] Int. Cl.[6] ..... B08B 3/04

[52] U.S. Cl. ..... 134/68; 134/76; 134/73; 134/82

[58] Field of Search ..... 136/66, 76, 186, 136/61, 68, 73, 82

[56] References Cited

U.S. PATENT DOCUMENTS

| | | | |
|---|---|---|---|
| 1,285,272 | 11/1918 | Lutolf | 134/76 |
| 3,082,675 | 3/1963 | Sousa et al. | 134/66 |
| 3,276,983 | 10/1966 | Dolan et al. | 134/66 |
| 3,476,126 | 11/1969 | Pinkham | 134/66 |
| 5,377,704 | 1/1995 | Huddle | 134/76 |

FOREIGN PATENT DOCUMENTS

| | | | |
|---|---|---|---|
| 56-5826 | 2/1981 | Japan . | |
| 62-27223 | 2/1987 | Japan . | |
| 259604 | 4/1970 | U.S.S.R. | 134/66 |

*Primary Examiner*—Frankie L. Stinson
*Attorney, Agent, or Firm*—Hedman, Gibson & Costigan

[57] ABSTRACT

Oil quenched works are immersed in water at a temperature of 75° C. while the works are maintained at a temperature of not lower than 100° C. In the step of immersing the works in water, the water boils on the surfaces of the works to remove most quenching oil from the surface of the works. A part of oil removed from the works is caused to overflow from the upper portion of a water bath and exhausted therefrom. In the step of immersing the works in water, the works are retained at a temperature suited for an alkaline cleaner. After having been taken out of the water, the works are cleaned in a step of showering water. A step of immersing the works in the alkaline cleaner is performed before the temperature of the works becomes lower than 60°C. The alkaline cleaner used in the step of immersing the works in the alkaline cleaner is maintained at a temperature of 70° C.±5° C. In this range of the temperature, quenching oil is continuously removed stably for a long time. The works are cleaned by water in a final washing step performed after the step of immersing the works in the alkaline cleaner. Thereafter, the works are dried by hot air in a drying step.

8 Claims, 12 Drawing Sheets

METHOD OF CLEANING WORKS AND CLEANING APPARATUS

BACKGROUND OF THE INVENTION

1. Field of the Invention

The present invention relates to a method of cleaning metallic works such as machine parts heat treated by oil quenching or the like and also relates to a cleaning apparatus.

2. Description of the Related Art

Steels parts such as gears and shafts used for a vehicle driving mechanism are frequently oil quenched. The oil quenching is performed by immersing works heated at a predetermined temperature in quenching oil, and much quenching oil is attached to the surfaces of the works. In order to remove the quenching oil, the works are cleaned by using a liquid cleaner such as water or an alkaline cleaner. Jpn. Pat. Appln. Kokoku Publication No. 56-5826, for example, discloses a cleaning method using a liquid cleaner boiled by heat of works generated by immersing the heated works in the liquid cleaner. In this prior art, the temperature of the liquid cleaner is maintained at 98° C. to 99° C. which is close to its boiling point, and the works are heated to a temperature higher than the boiling point of the cleaner. Oil is removed from the surfaces of the works by bubbles produced from the boiling liquid cleaner. Since, however, cleaning is made only once, such a problem is likely to arisen that the quenching oil is not completely removed from the surfaces of the works. A further problem is likely to occur that the liquid cleaner is mixed with much quenching oil when the works are immersed in the liquid cleaner soon after the oil quenching process. As affinity between the oil and the liquid cleaner heated to a temperature close to its boiling point is high, much oil is emulsified in the liquid cleaner, and it becomes difficult to separate the oil from the liquid cleaner, making it hard to remove the oil from the liquid cleaner. In addition, the oil in the liquid cleaner is easily attached to the works again when the works are taken out of the liquid cleaner. When an alkaline cleaner as a liquid cleaner is heated to a temperature close to its boiling point as described in the above Publication, the continuity of oil removing ability of the cleaner is greatly reduced. Thus, the liquid cleaner must be exchanged or supplemented frequently, thereby increasing the running cost.

SUMMARY OF THE INVENTION

It is accordingly the object of the present invention to provide a method of cleaning works and a cleaning apparatus in which the cleaning effect is high, deterioration of a liquid cleaner is lowered and quenching oil is easily separated from the liquid cleaner.

In order to achieve the object, the present invention provides a method of cleaning works after having been quenched by immersing the works in quenching oil comprising:

a first step of immersing works to be quenched in first water for a predetermined time while the works are maintained at a temperature not less than 100° C.;

a second step of showering the works taken out of the first water with second water by spraying the second water on the works;

a third step of immersing the works in an alkaline cleaner for a predetermined time after the second step;

a fourth step of removing the alkaline cleaner from the surfaces of the works by spraying third water on the works taken out of the alkaline cleaner; and a fifth step of drying the works after the fourth step.

when the works at a temperature of not less than 100° C. are immersed in water in the first step, the water boils on the surfaces of the works, and quenching oil is removed from the surfaces of the works. In the first step, the temperature of the works is preferably lowered to a temperature between 60° C. and 80° C. which is suited for the alkaline cleaner. The higher the temperature of water, the lower the viscosity of oil is, thereby enhancing the cleaning effect. However, as the temperature of the water approaches its boiling point, the affinity between the water and the oil becomes too high, whereby the oil is easily emulsified. When, on the other hand, the temperature of the water is too low, the affinity between the oil and the water is low and cleaning ability is also lowered.

According to the present invention, water is preferably maintained at a preferable temperature of not less than 60° C. so that the affinity between the water and the oil becomes proper in the first step. This makes it easy to remove the oil from the surfaces of the works. Further, since the temperature of the water is not more than 80° C., the affinity between the oil and the water is not too high. Thus, the oil is hard to be emulsified and is separated from the water in a relative short time. Consequently, the oil removed from the water can be exhausted from a water bath by causing the water containing the oil to overflow from the water bath and the oil exhausted therefrom is easily processed by a water-oil separator. For this reason, the range of the temperature of the water is preferably between 60° C. and 80° C., and more preferably 75° C.±5° C.

In the experiments made by the inventors of the present invention, quenching oil of 30 ml was mixed with water of 30 ml and they were stirred quickly. It was found that most oil was separated from the water in five minutes at a temperature of 75° C. of the water. In contrast, when the temperature of the water was 95° C., the oil was not separated from the water but remained emulsified.

After the first step of immersing the works in the first water, most of the oil left on the surfaces of the works is removed by spraying water in the second step of showering the works with the second water. The remaining oil on the surfaces of the works is removed almost completely in the third step of immersing the works in the alkaline cleaner. Thereafter, the works are processed in the fourth step of removing the alkaline cleaner from the works and then in the fifth step of drying the works. In this way, the cleaning of the works is completed. In particular, the second step of showering the works with water to lower the temperature of the works to the temperature suited for the alkaline cleaner used in the third step is preferable because the alkaline cleaner exhibits the required cleaning effect. Moreover, the oil removing ability is not lowered at this low temperature.

The alkaline cleaner used in the third step is an inorganic agent and contains a surface active agent having oxyethylene chains. The cleaner has a cloud point in the vicinity of 60° C. At the cloud point, the connection between water molecules and oxyethylene chains which are hydrated with each other is broken. Upon heating the cleaner to a temperature higher than the cloud point, the surface active ability of the surface active agent in the cleaner cannot be expected to be elevated. The cleaning ability is enhanced as the temperature increases up to about 80° C. At a temperature higher than 80° C., separation of the surface active agent is quickened, resulting in lowering continuity of oil removal from the works. Thus, it is recommended that the temperature range of the alkaline cleaner be between 60° C. to 80° C., particularly 70° C.±5° C.

Since the amount of the oil brought to the alkaline cleaner is very little when the method of the present invention is used, the frequency of exchanging the cleaner is reduced greatly and the cleaner can be disposed of easily.

A cleaning apparatus for performing this method comprises:

a water chamber having a water bath for containing first water in which works to be cleaned are immersed;

first lifting means provided in the water chamber, having first supporting means for supporting the works and moving the works supported by the first supporting means between a position at which the works are immersed in the first water and a position at which the works are taken out of the first water;

an alkaline cleaner chamber having an alkaline cleaner bath containing an alkaline cleaner in which the works are immersed;

second lifting means provided in the alkaline cleaner chamber, having second supporting means for supporting the works, and moving the works supported by the second supporting means between a position at which the works are immersed in the alkaline cleaner and a position at which the works are taken out of the alkaline cleaner;

a water spraying chamber provided between the water chamber and the alkaline cleaner chamber and having means for spraying second water on the works; and a work feeding device provided in the water spraying chamber and comprising:

a horizontally reciprocating carriage; and a driving mechanism for moving the carriage;

the carriage provided with a pusher for moving the works from the water chamber to the water spraying chamber when the works are in the water chamber and another pusher for moving the works in the water spraying chamber to the alkaline cleaner chamber when the works are in the water spraying chamber.

The works are lowered and rised by the first and second lifting means upon immersing the works in the water bath and the alkaline cleaner bath, respectively. In this case, the carriage of the horizontally movable work feeding device is retracted to the water spraying chamber. Because it is unnecessary to lift the works in the water spraying chamber, the carriage can be held in the water spraying chamber while the second step of washing the works is performed.

DETAILED DESCRIPTION OF THE PREFERRED EMBODIMENTS

One embodiment of the present invention will be described with reference to FIGS. 1 to 15.

Figure 1:
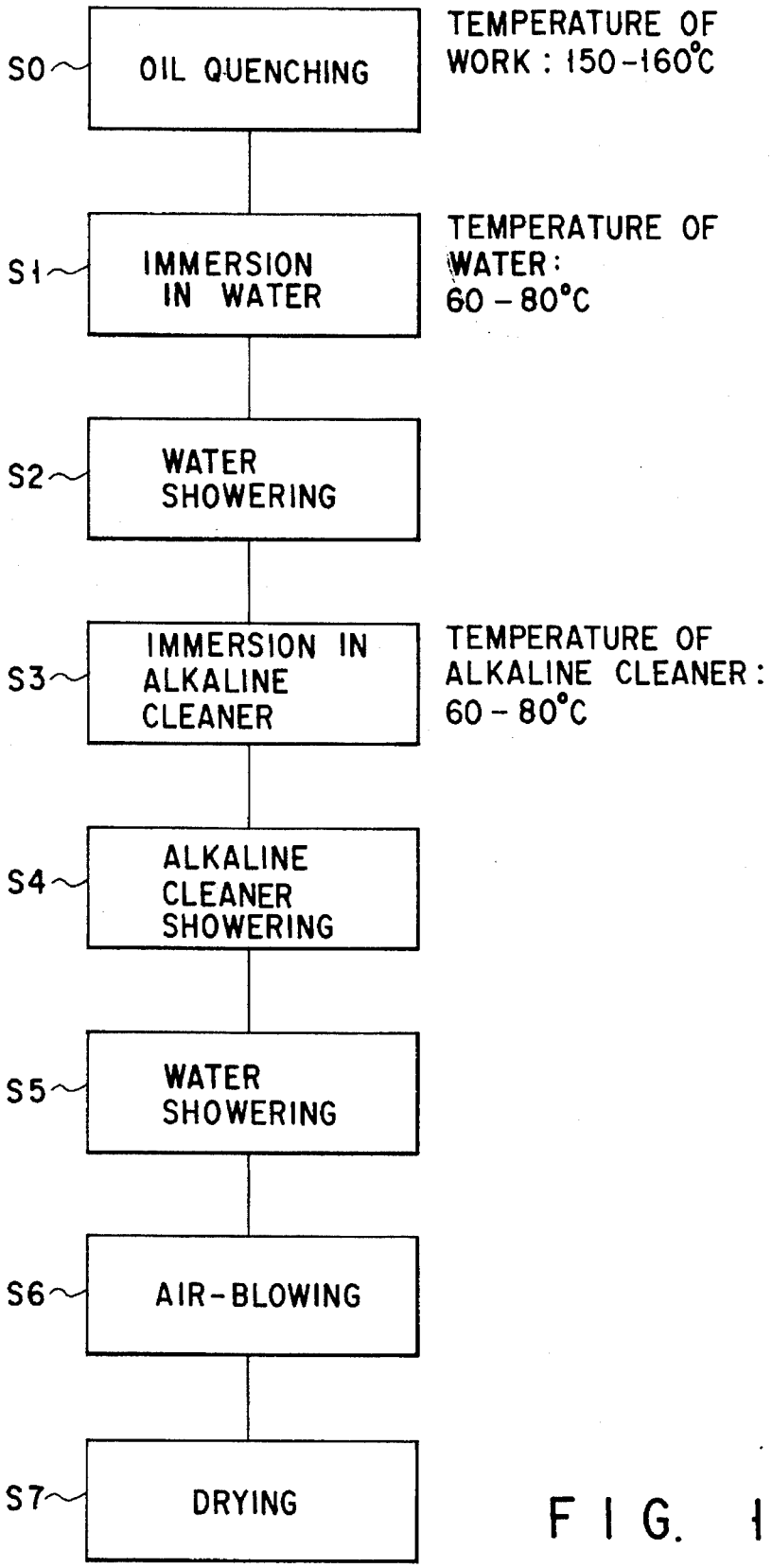
FIG. 1 is a flow chart illustrating the cleaning processes of one embodiment of the present invention.
Figure 14:
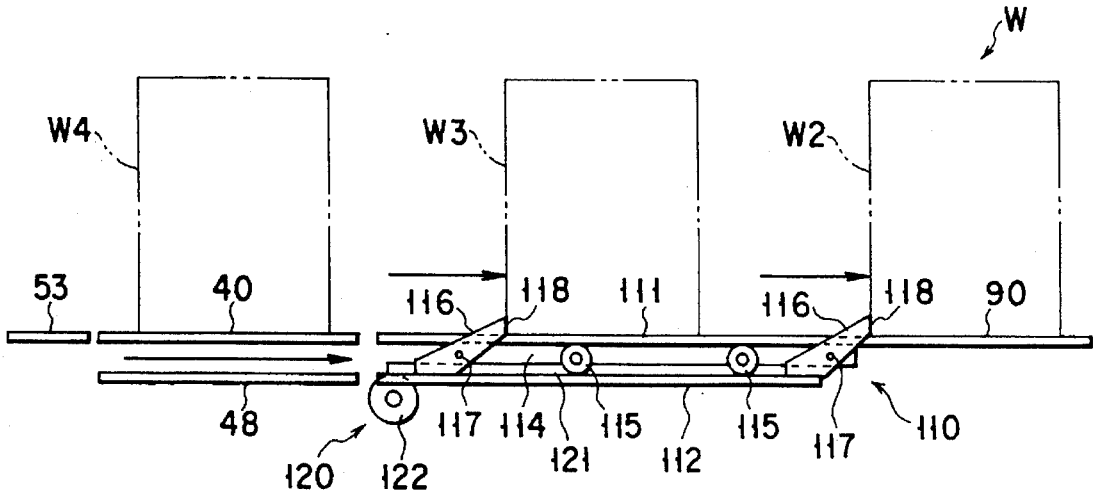
FIG. 14 is a general side view of the carriage of the work feeding device shown in FIG. 11 in a state in which the carriage is advanced.
Figure 15:
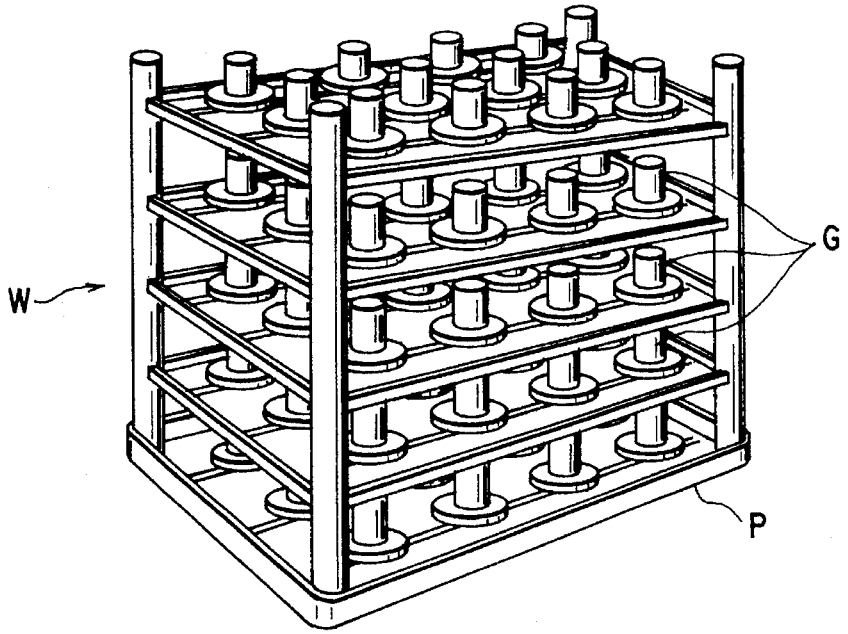
FIG. 15 is a perspective view of an example of works.

An outline of cleaning processes is shown in FIG. 1, and one embodiment of a cleaning apparatus 10 for performing the cleaning processes is shown in FIGS. 2 to 14. FIG. 15 shows an example of works W to be cleaned. The cleaning apparatus 10 is used for removing quenching oil attached to the works W.

The work W comprises many to-be-quenched members G such as gears to be cleaned and a pallet P on which the to-be-quenched members G are mounted. Since the to-be-quenched members G and the pallet P are handled as a unit, this unit is called a work W.

The members G are oil quenched in a heat treating step S0 in FIG. 1. The oil quenching is performed by immersing the to-be-quenched members G in quenching oil after the to-be-quenched member G have been heated to a predetermined temperature by a furnace of a quenching device (not shown). The quenching oil is held in an oil bath of the quenching device at a temperature between 150° C. to 160° C. An example of the quenching oil is B-90 of Daido Chemical Industries Co., Ltd. and has a flashing point of 272° C., viscosity of 20.69 cst at 98.9° C. and a specific gravity of 0.885. It's working temperature is 120° C.–180° C.

The members G is retained at a temperature of not less than 100° C. after having been quenched. The works W including the members G at this high temperature are immersed in water held at a temperature of 75° C. in a step S1 of immersing the works in water. The water boils on the surfaces of the works W to produce bubbles on the surfaces of the works W continuously. Thus, most of the quenching oil is separated from the surfaces of the works W in the water. The works W are taken out of the water in a predetermined time.

In a step S2 of showering the works With water, water is showered to the works W to clean the surfaces of the works W further. In the next step S3, the works W are immersed in an alkaline cleaner for a predetermined time and are taken out of the alkaline cleaner. In a step S4, an alkaline cleaner is showered on the works W. In a step S5 which is a finishing step, water is showered on the works W to remove the alkaline cleaner from the surfaces of the works W. In a step S6, air is blown to the surfaces of the works W whereby water is blown away from the works W. In a step S7, the works W are dried.

Figure 2:
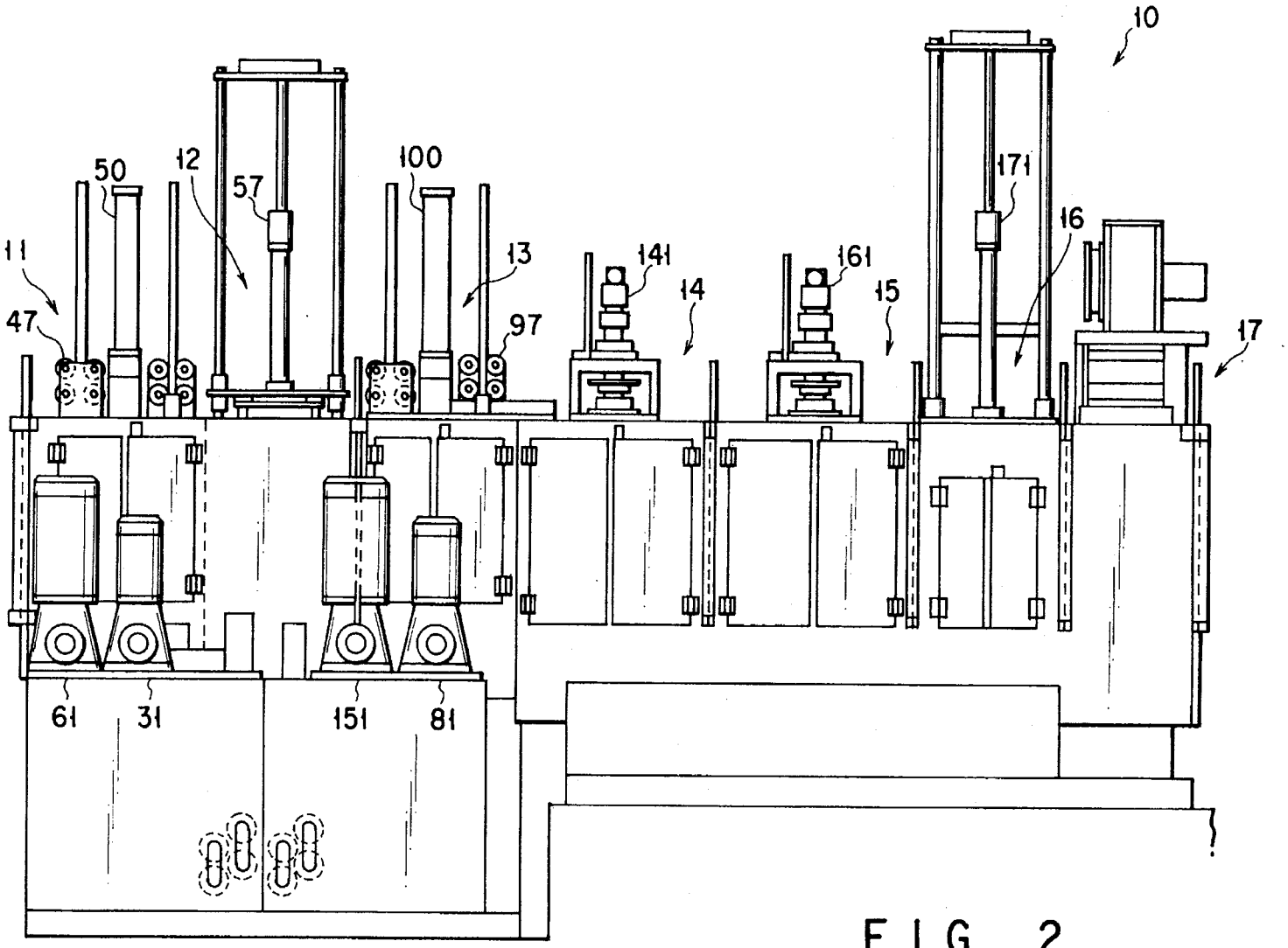
FIG. 2 is a front view of one embodiment of a cleaning apparatus according to the present invention.
Figure 3:
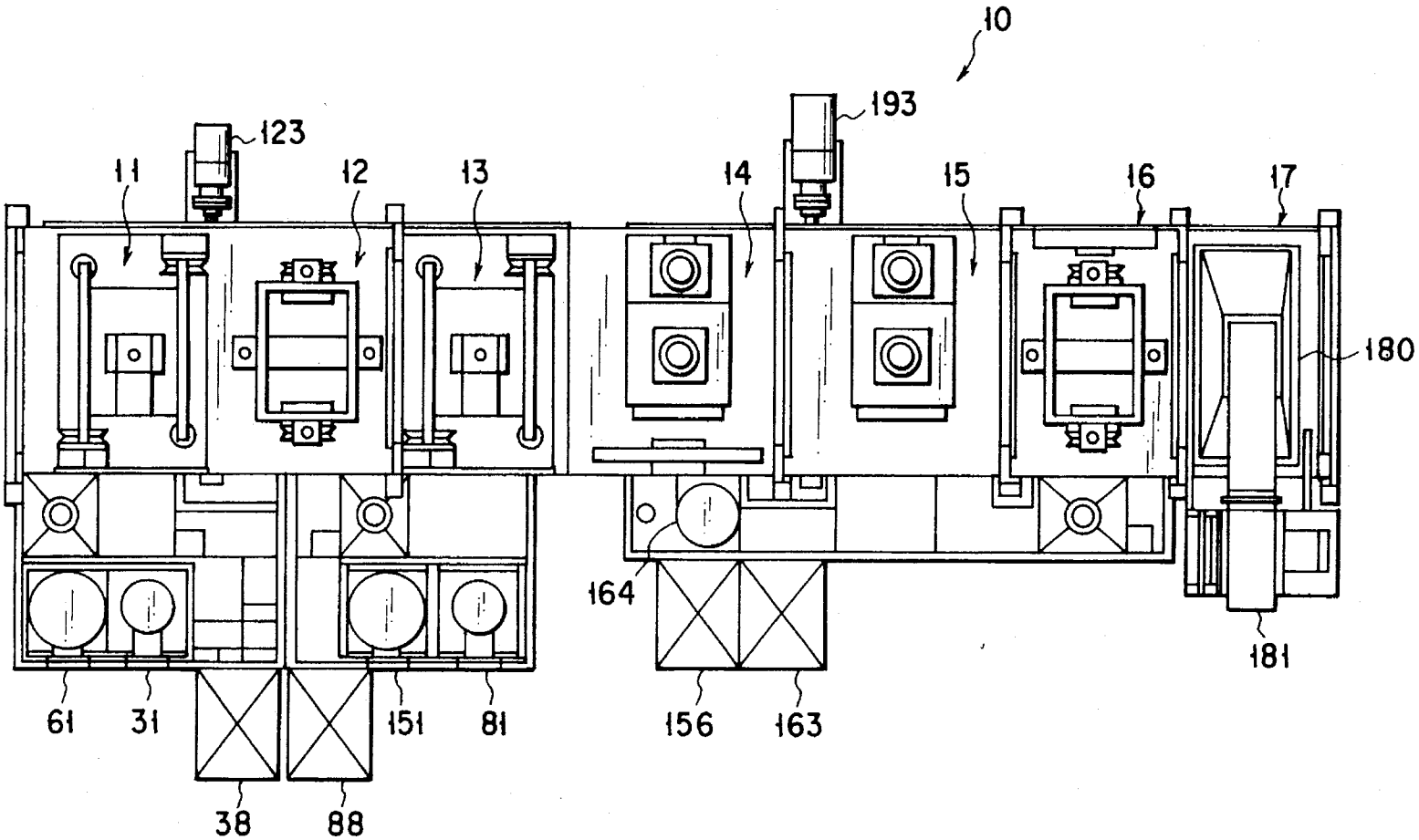
FIG. 3 is a plan view of the cleaning apparatus shown in FIG. 2.

The cleaning apparatus 10 as shown in FIGS. 2 and 3 intermittently moves the works W from the left side to the right side in these figures and performs the steps S1 to S7. A water chamber 11 for performing the step S1, a water spraying chamber 12 for performing the step S2, an alkaline cleaner chamber 13 for performing the step S3, an alkaline cleaner spraying chamber 14 for performing the step S4, a final spraying chamber 15 for performing the step S5, an air blowing chamber 16 for performing the step S6 and a drying chamber 17 for performing the step S7 are arranged along the transporting path of the works W.

Figure 4:
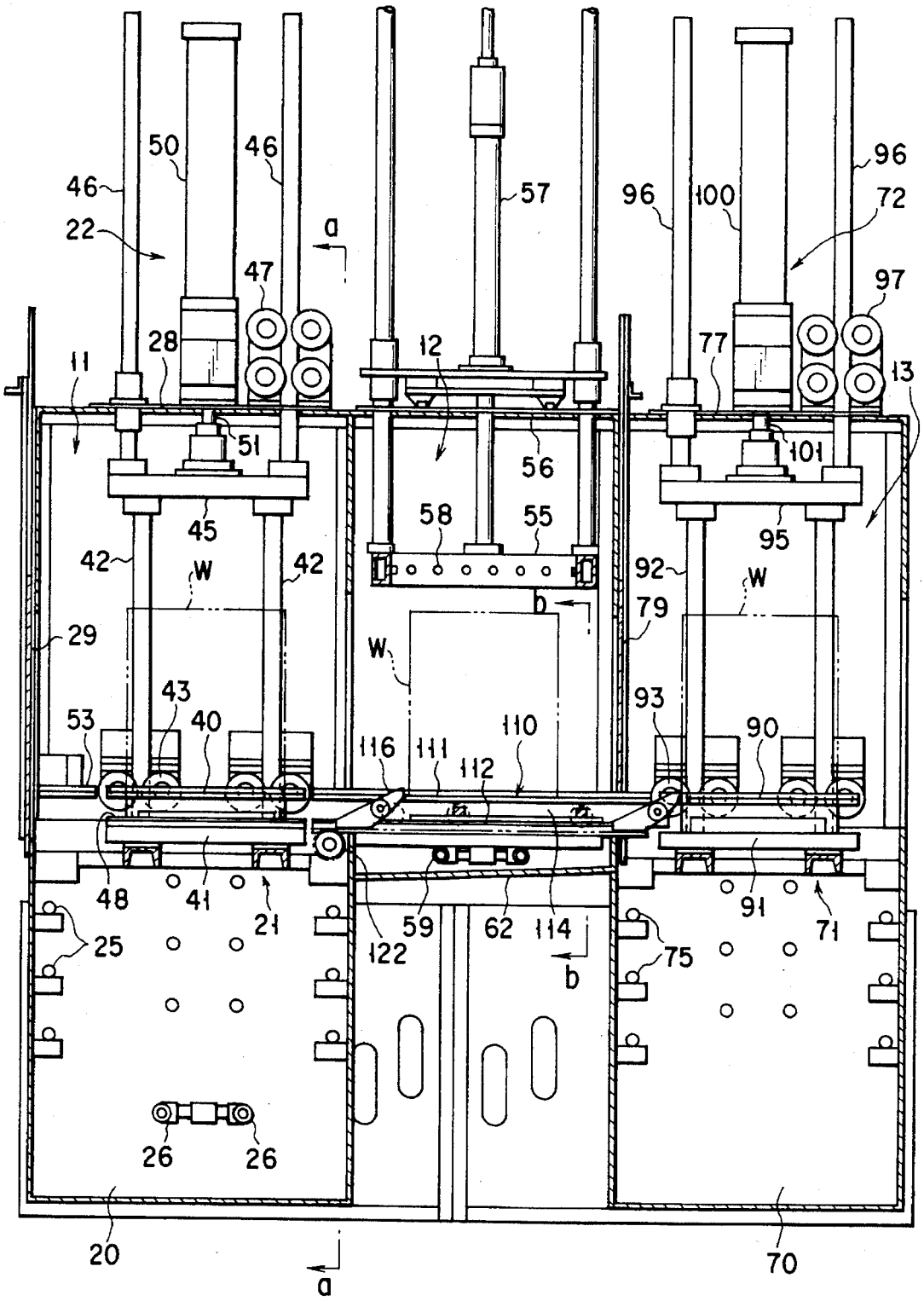
FIG. 4 is a longitudinal cross-section of a water chamber, a water spraying chamber and an alkaline cleaner chamber of the cleaning apparatus shown in FIG. 2.
Figure 5:
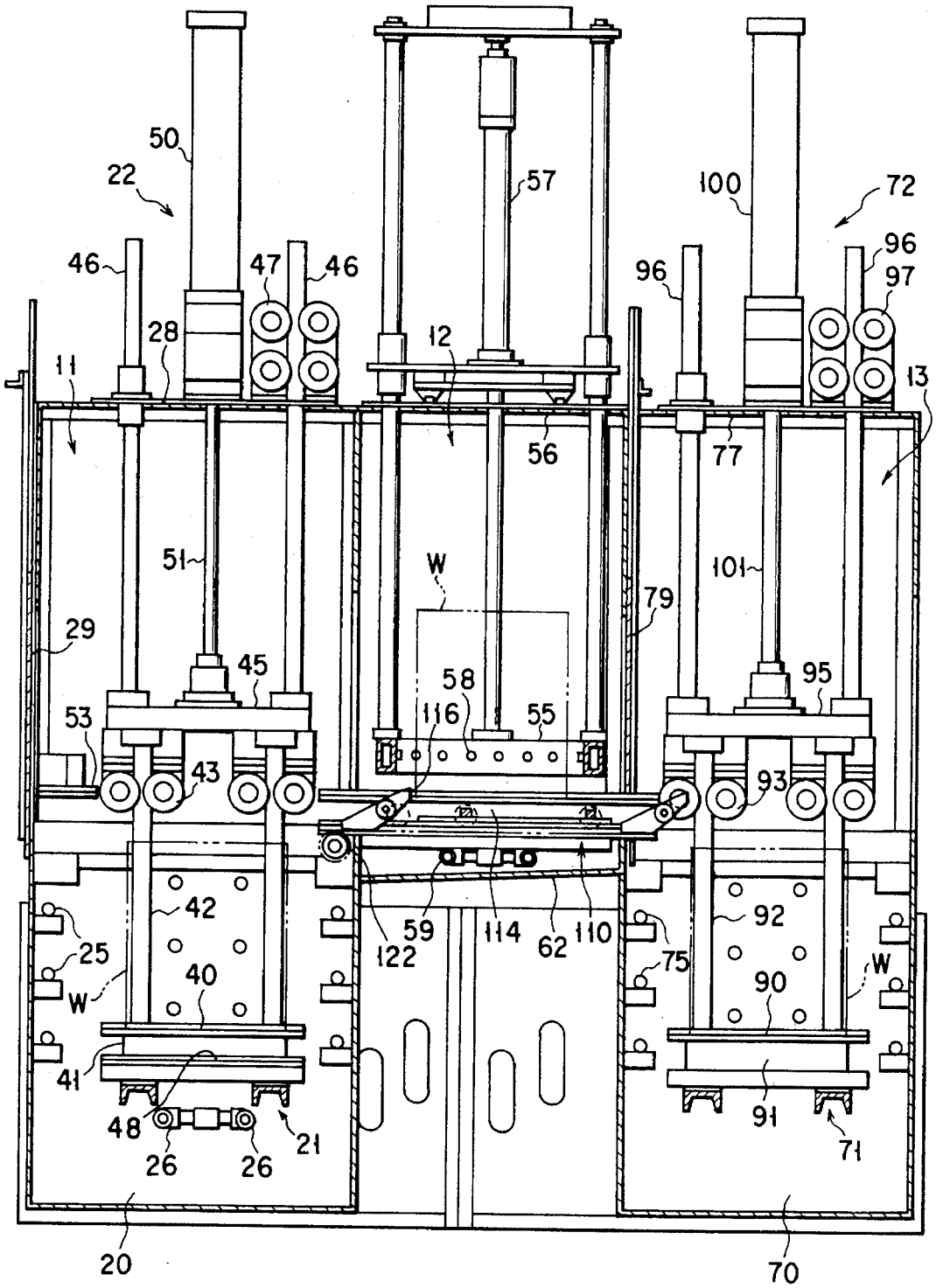
FIG. 5 is a longitudinal cross-sectional view of the water chamber, a water spraying chamber and the alkaline cleaner chamber shown in FIG. 4 and shows a state in which lifting mechanisms are operated.
Figure 6:
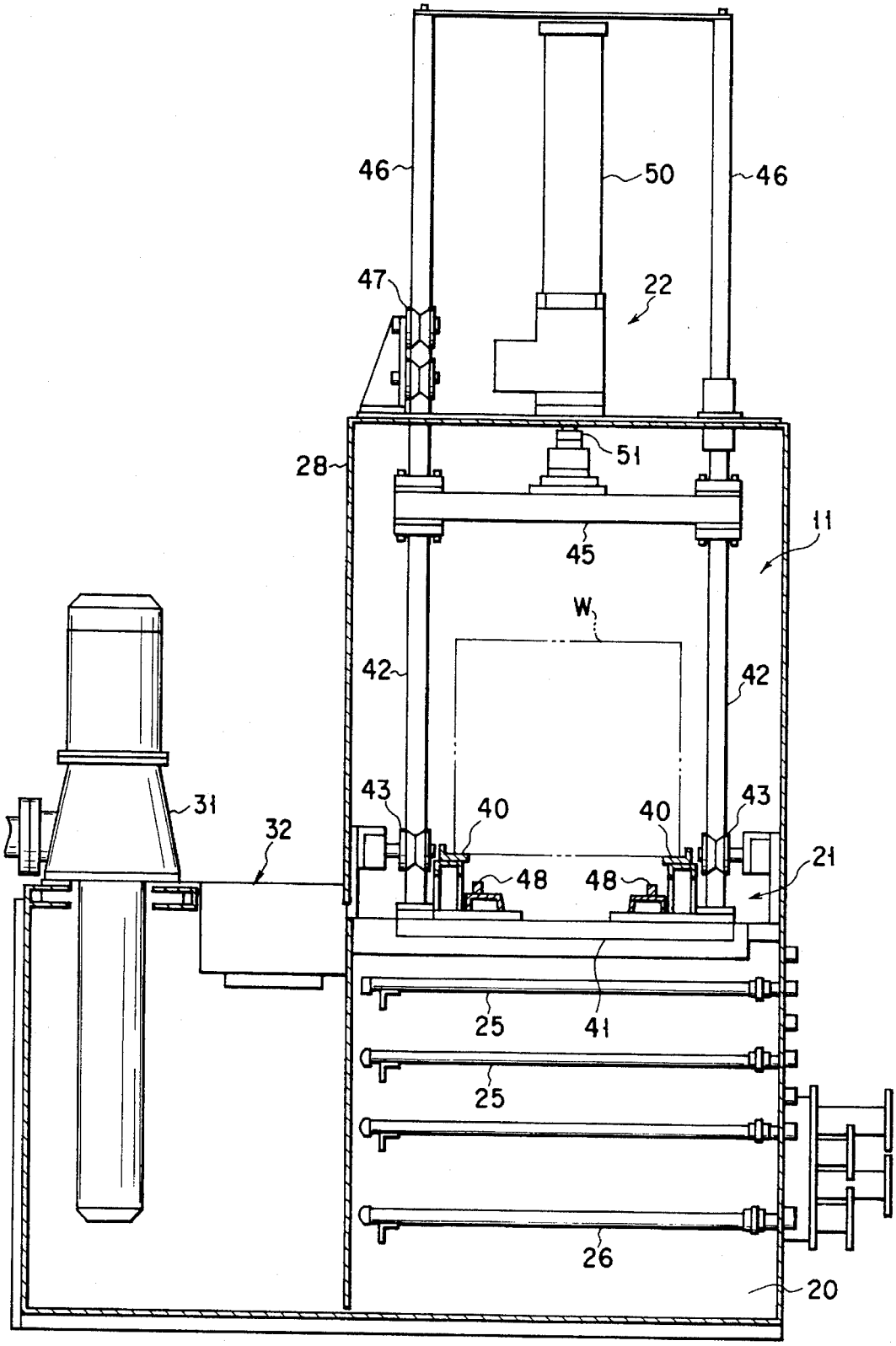
FIG. 6 is a cross-sectional view along line a—a in FIG. 4.

As shown in FIGS. 4 to 6, the water chamber 11 is provided with a water bath 20 and first lifting means movable upward and downward. The first lifting means includes a first lifting unit 21 and a first vertically driving mechanism 22 for moving the first lifting unit 21 upward and downward. Water spraying nozzles 25 for generating water flow and air nozzles 26 for generating air bubbles are provided in the water bath 20. The upper portion of the water bath 20 has a shape which allows water to overflow. The water chamber 11 is covered with a cover 28, and a door 29 is provided at the entrance of the chamber 11. The door 29 is opened when the works W are transported into the chamber 11.

Figure 9:
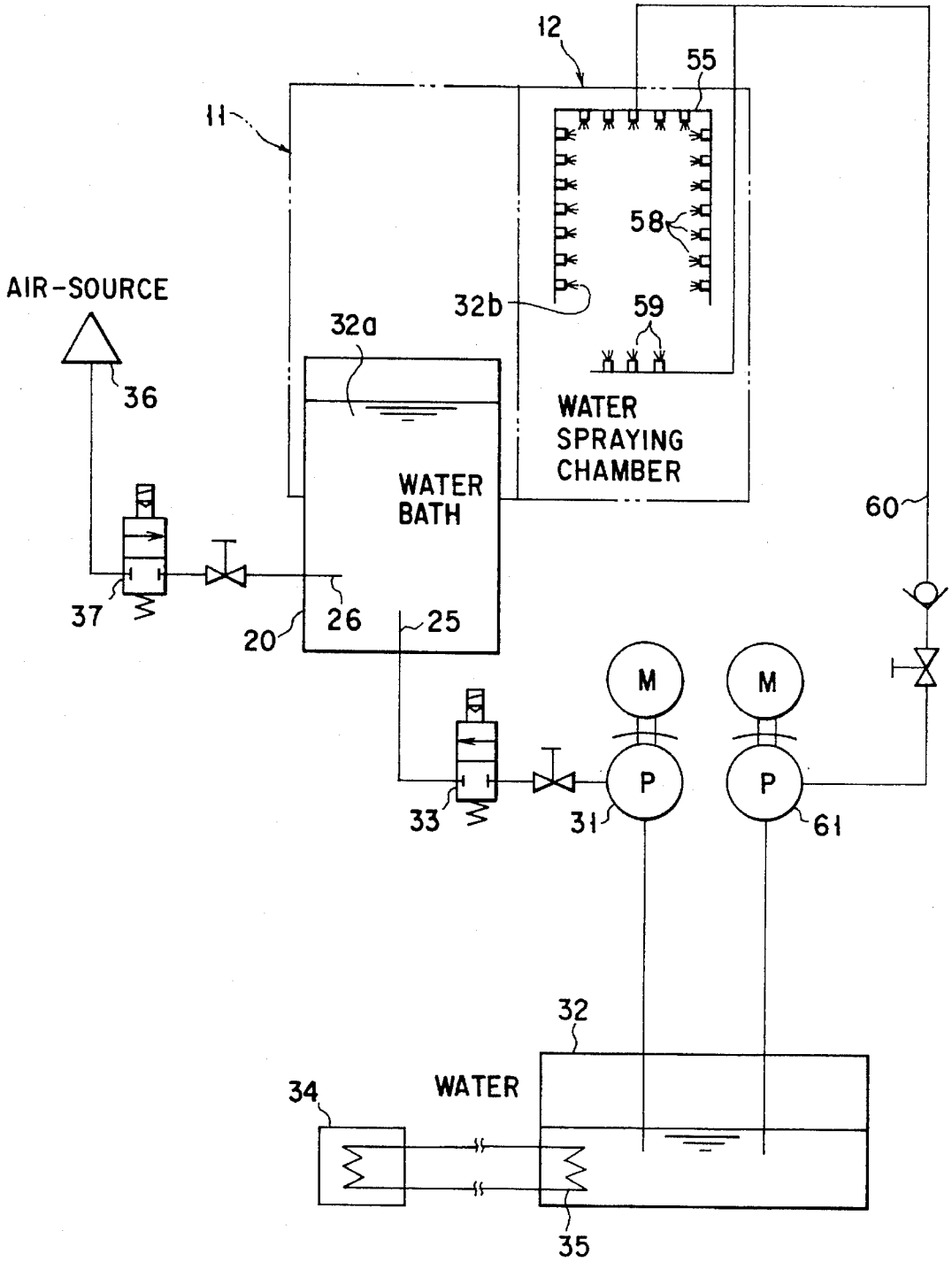
FIG. 9 is a schematic diagram of a piping system of a water bath and a water spraying chamber of the cleaning apparatus shown in FIG. 2.

As shown in FIG. 9, the water spraying nozzles 25 spray water 32*a* from water tank 32 into the water bath 20 by a pump 31 through an opening and closing valve 33. A heat exchanger 35 is provided in the water tank 32 and performs heat exchange between water in the water tank 32 and the quenching oil in an oil bath 34 of the oil quenching device and holds the water in the water tank 32 at a temperature of 75° C., for example. The air nozzles 26 spray compressed air from an air source 36 into the water in the water bath 20 through an opening and closing valve 37. Water overflowing from the water bath 20 is separated into water and oil by a water-oil separator 38 (a part of which is shown in FIG. 3).

As shown in FIG. 6, etc., the first lifting unit 21 has a pair of sliding guides 40 each having an L-shaped cross section, and arranged at the right and left sides, as supporting means for supporting the undersurfaces of the works W. Each sliding guide 40 extends horizontally. The first lifting unit 21 comprises a lift frame 41 for supporting the sliding guides 40, supporting stands 42 extending upward from the lift frame 41, guiding wheels 43 for guiding the supporting stands 42 so that the stands 42 are moved linearly vertically, a beam 45 bridging the upper ends of the supporting stands 42, guide rods 46 extending upward from the beam 45, and guide wheels 47 for guiding one of the guide rods 46 so that the guide rods 46 are moved linearly vertically. A pair of rails 48 are arranged at the right and left sides on the lift frame 41.

The first vertically driving mechanism 22 has a cylinder mechanism 50 provided on the upper surface of the cover 28. When the rod 51 of the cylinder mechanism 50 is extended, the lifting unit 21 is lowered as shown in FIG. 5, and the works W on the lifting unit 21 are immersed in the hot water in the water bath 20. When, on the other hand, the rod 51 of the cylinder mechanism 50 shrinks, the lifting unit 21 is lifted as shown in FIG. 4, and the works W are taken out of the water bath 20. A fixed sliding guide 53 is provided in the vicinity of the door 29 at the same level as that of the sliding guides 40.

The water spraying chamber 12 has a vertically movable nozzle unit 55 which is moved upward and downward by a lifting cylinder mechanism 57 provided on the cover 56. The nozzle unit 55 is lowered by surrounding the works W and then lifted. This operation is repeated. Nozzles 58 are formed in the inner wall of the nozzle unit 55. Fixed nozzles 59 are provided in the water spraying chamber 12 in the vicinity of its bottom 62. As shown in FIG. 9, the nozzles 58 and 59 are connected to the water tank 32 through a water supplying pipe 60 and a pump 61 so that the nozzles 58 and 59 spray water 32*b* at a temperature of 60° C. to 80° C. from the water tank 32 on the works W in the water spraying chamber 12.

Alkaline cleaner chamber 13 has an alkaline cleaner bath 70 and second lifting means. The second lifting means comprises a second lifting unit 71, a second vertically driving mechanism 72 for moving the second lifting unit 71 upward and downward and other elements. Cleaner spraying nozzles 75 and air nozzles 76 for generating air bubbles are provided in the alkaline cleaner bath 70 (see FIG. 10). The alkaline cleaner chamber 13 is covered with a cover 77, and a door 79 is provided at the entrance of the chamber 13.

Figure 10:
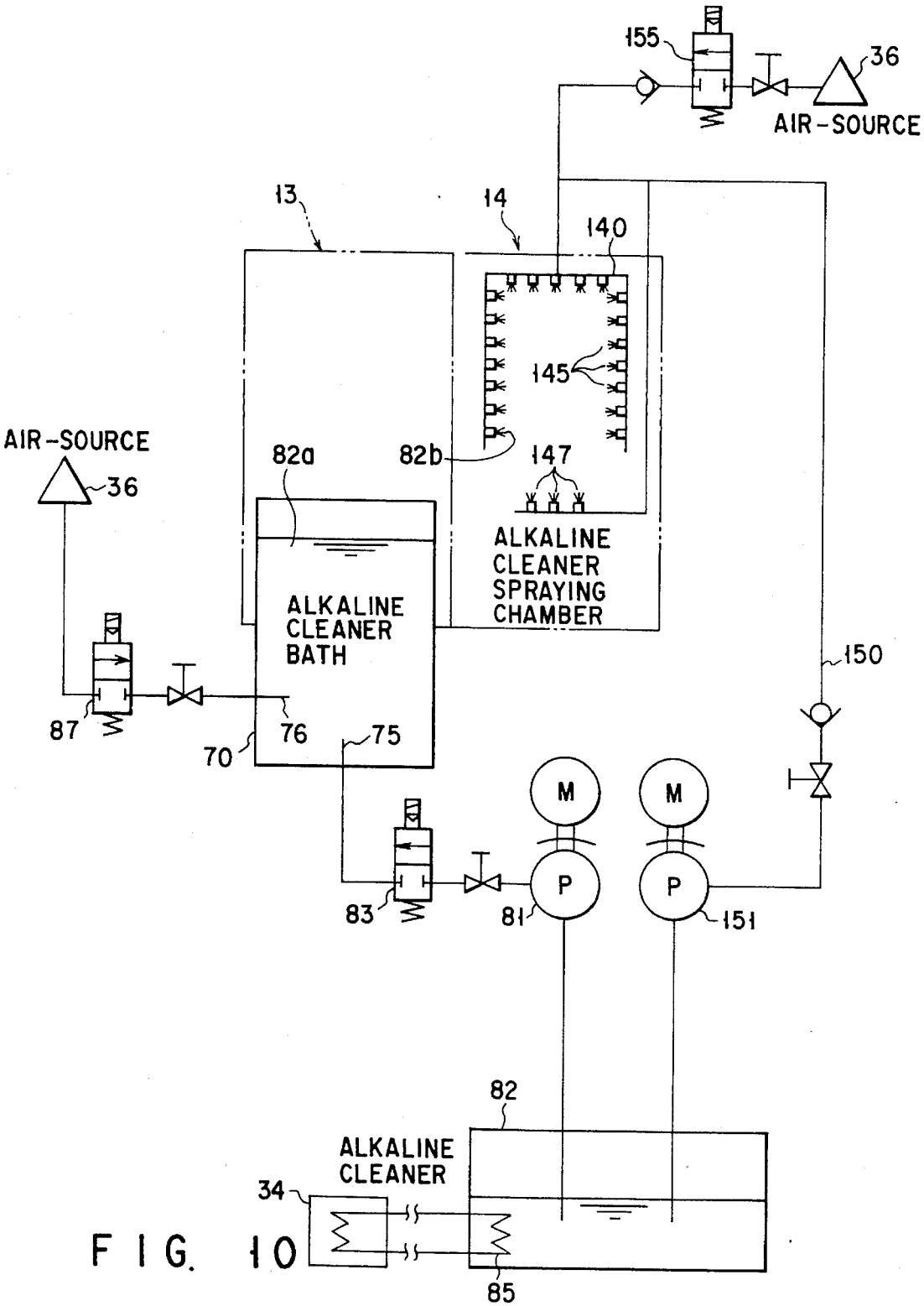
FIG. 10 is a schematic diagram of a piping system of an alkaline cleaner bath and an alkaline cleaner spraying chamber of the cleaning apparatus shown in FIG. 2.

As shown in FIG. 10, the cleaner spraying nozzles 75 spray the alkaline cleaner 82*a* from an alkaline cleaner tank 82 into the alkaline cleaner bath 70 by a pump 81 through an opening and closing valve 83. A heat exchanger 85 is provided in the alkaline cleaner tank 82 and performs heat exchange between the alkaline cleaner in the tank 82 and the quenching oil in the oil bath 34 of the quenching device to hold the alkaline cleaner in the tank 82 at a temperature between 60° C. to 80° C. (preferably 75° C.±5° C.). The air nozzles 76 spray compressed air supplied from the air source 36 into the alkaline cleaner in the alkaline cleaner bath 70 through an opening and closing valve 87. Alkaline cleaner overflowing from the alkaline cleaner bath 70 is cleaned by an oil-water separator 88 (a part of which is shown in FIG. 3).

The second lifting unit 71 has a pair of sliding guides 90 each having an L-shaped cross section, as a supporting means for supporting the undersurfaces of the works W, and arranged at the right and left sides. Each sliding guide 90 extends horizontally. The second lifting unit 71 comprises a lift frame 91 for supporting the sliding guides 90, supporting stands 92 extending upward from the lift frame 91, guide wheels 93 for guiding the vertical movement of the supporting stands 92, a beam 95 for bridging the upper ends of the supporting stands 92, guide rods 96 extending upward from the beam 95, and guide wheels 97 for guiding the vertical movement of the guide rods 96.

The second vertically driving mechanism 72 has a cylinder mechanism 100 provided on the upper surface of the cover 77. When a rod 101 of the cylinder mechanism 100 is extended, the second lifting unit 71 is lowered, as shown in FIG. 5, and the works w on the second lifting unit 71 are immersed in the alkaline cleaner bath 70. When, on the other hand, the rod 101 of the cylinder mechanism 100 shrinks, the second lifting unit 71 is lifted as shown in FIG. 4, and the works W are taken out of the alkaline cleaner bath 70.

A work feeding device 110 is provided in the water spraying chamber 12 and has the following structure so as to transport the works w horizontally intermittently.

Figure 7:
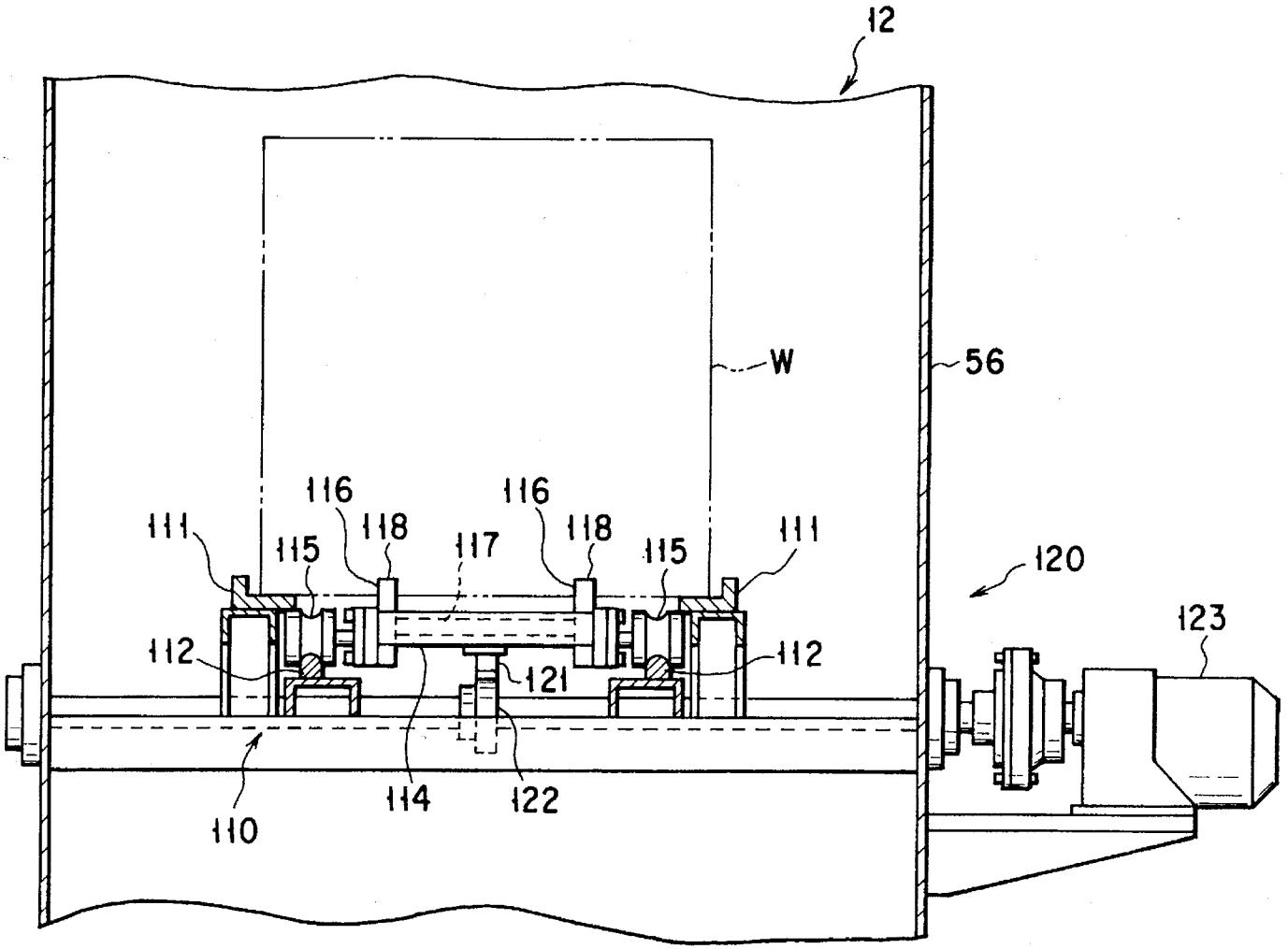
FIG. 7 is a cross-sectional view along line b—b in FIG. 4.

As shown in FIG. 7, etc., a pair of sliding guides 111 each having an L-shaped cross section and disposed at the right and left sides so as to support the undersurfaces of the works W and a pair of rails 112 disposed at the right and left sides are provided in the water spraying chamber 12. The sliding guides 111 and the rails 112 extend horizontally. Wheels 115 of a carriage 114 ride on the rails 112 so that the carriage 114 is moved toward the right side and the left side in FIG. 4 along the rails 112.

Figure 11:
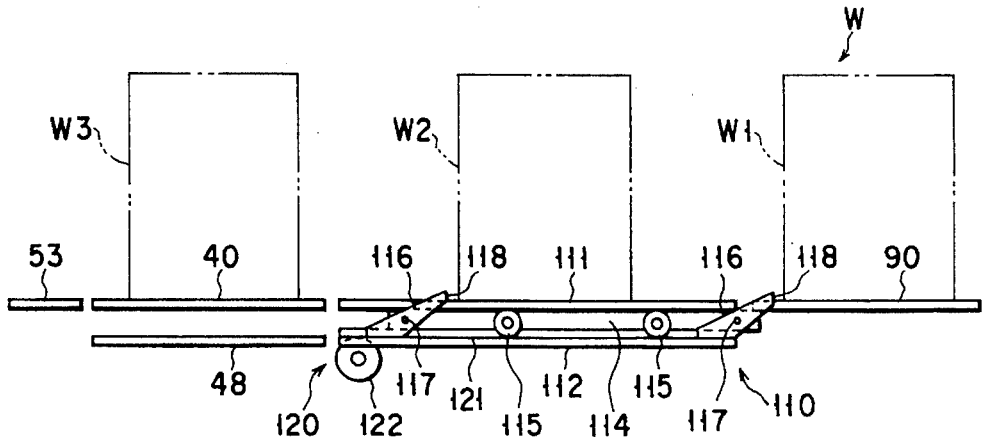
FIG. 11 is a general side view of a work feeding device of the cleaning apparatus shown in FIG. 2.
Figure 12:
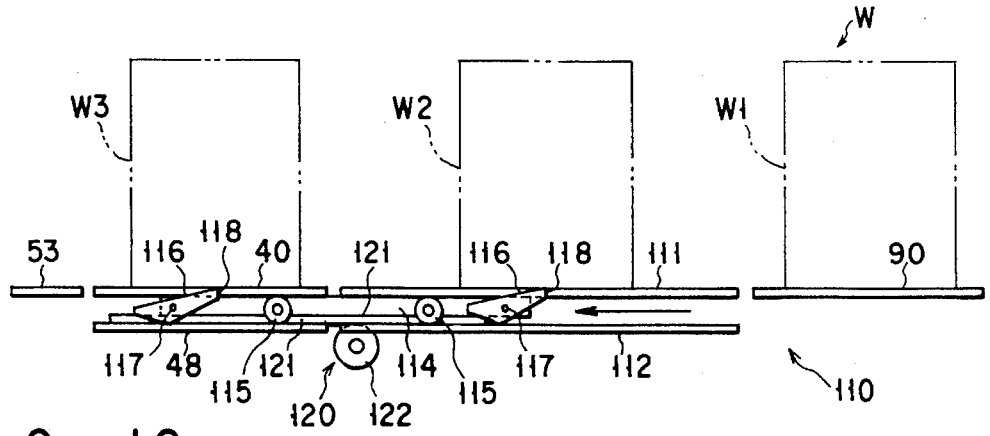
FIG. 12 shows operation of a carriage of the work feeding device shown in FIG. 11.

Pushers 116 are provided on the carriage 114. As schematically shown in FIG. 11, the pushers 116 are connected to the carriage 114 by shafts 117. Each pusher 116 can be rotated between a first position at which the front portion 118 of the pusher 116 projects slantwise upward (FIG. 11) and a second position at which the front portion 118 is lowered from the first position (FIG. 12). In a free state in which no external force is applied to the pusher 116, the front portion 118 takes the first position at which the front portion 118 projects slantwise upward by the urging force of a torsion spring (not shown) and the weight of the pusher 116.

The carriage 114 is reciprocated horizontally by a suitable driving mechanism 120 such as a pinion-rack assembly. In FIGS. 11 and 12, a rack 121 is provided on the carriage 114. As a pinion 122 engaging the rack 121 is rotated by a motor 123, the carriage 114 is advanced or retracted.

It is assumed that works W1, W2 and W3 are arranged from the forward side toward the rear side in this order as shown in FIG. 11. As the carriage 114 is moved rearward (in the left direction) as shown by an arrow in FIG. 12, the pushers 116 slide on the undersurfaces of the works W1 to W3 and fall. The carriage 114 is moved to the position shown in FIG. 13 in a state in which the pushers 116 escape from the works W1 to W3. In a state of FIG. 13, the front portions 118 of the pushers 116 are raised and take the state in which they can push the rear faces of the works W1 to W3.

Thereafter, the carriage 114 is advanced by one stroke so that the works W2 and W3 are pushed by the pushers 116 and moved to predetermined positions. At the same time, the works W1 disposed at the top of the row of the works W1 to W3 are also advanced by one stroke by a carriage 191 of the alkaline cleaner chamber 13 and take the state as shown in FIG. 14. New works W4 are supplied and loaded on the sliding guides 40 of the water chamber 11.

Figure 8:
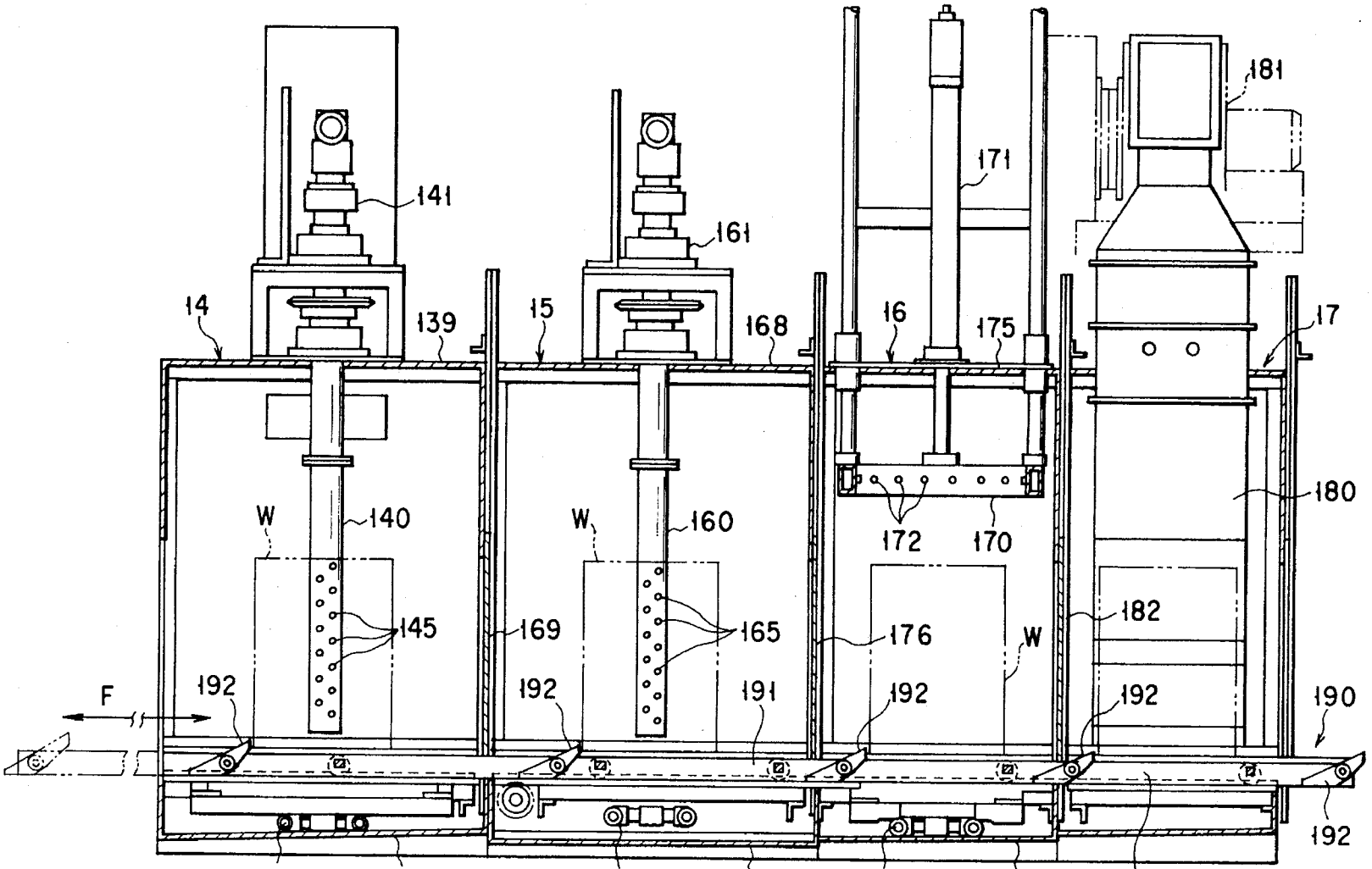
FIG. 8 is a longitudinal cross-sectional view of spraying chambers, a drying chamber, etc. of the cleaning apparatus shown in FIG. 2.

As shown in FIG. 8, the alkaline cleaner spraying chamber 14 is provided with a nozzle unit 140 which is disposed inside a cover 139 and rotatable in both directions around its vertical axis. The nozzle unit 140 has a gate shape so as to face both sides of the works W in the chamber 14 and is rotated by a rotationally driving mechanism 141. Nozzles 145 are formed in the inner walls of the nozzle unit 140. Fixed nozzles 147 are provided in the alkaline cleaner spraying chamber 14 in the vicinity of its bottom 146. As shown in FIG. 10, the nozzles 145 and 147 are connected to the alkaline cleaner tank 82 through a cleaner supplying pipe 150 and a pump 151. The alkaline cleaner **82*b* is supplied from the alkaline cleaner tank 82 to the cleaner supplying pipe 150 by the pump 151 and is sprayed from the nozzles 145 and 147 into the spraying chamber 14. The air source 36 is connected to the nozzle 145 through an opening and closing valve 155. The alkaline cleaner used in the spraying chamber 14 is cleaned by an oil-water separator 156 (a portion of which is shown in FIG. 3**).

The final spraying chamber 15 is also provided with a nozzle unit 160 rotatable around its vertical axis. The nozzle unit 160 has a gate shape so as to face both sides of the works W in the chamber 15 and is rotated by a rotationally driving mechanism 161. Nozzles 165 are provided in the inner wall of the nozzle unit 160. Fixed nozzles 167 are provided in the final spraying chamber 15 in the vicinity of its bottom 166. The nozzles 165 and 167 are connected together by a pump 164 (a part of which is shown in FIG. 3) through a water supplying pipe (not shown). Clean hot water supplied from the water tank 32 is sprayed from the nozzles 165 and 167 into the final spraying chamber 15.

The final spraying chamber 15 is covered with a cover 168. A door 169 is provided at the entrance of the spraying chamber 15 and is opened when the works W are supplied in the chamber 15. The water used in the final spraying chamber 15 is cleaned by an oil-water separator 163 (a part of which is shown in FIG. 3).

The air blowing chamber 16 is provided with a vertically movable nozzle unit 170 which is moved upward and downward by a vertically driving mechanism 171 using an air cylinder or the like. Air nozzles 172 are provided in the inner wall of the nozzle unit 170. The nozzle unit 170 is lowered in a state in which it surrounds the works W in the air blowing chamber 16 and then lifted. This operation is repeated. During this operation, hot air from the nozzles 172 is blown to the works W. Fixed nozzles 174 are provided in the air blowing chamber 16 in the vicinity of its bottom 173. Hot air is blown out also from the nozzles 174. The air blowing chamber 16 is covered with a cover 175. A door 176 is provided at the entrance of the air blowing chamber 16 and is opened when a work W is introduced in the chamber 16.

In the drying chamber 17 is provided an air blower 181 for blowing hot air to the works W housed in the chamber portion 180. A door 182 is provided at the entrance of the drying chamber 17 and is opened when works W are transmitted into the drying chamber 17.

As shown in FIG. 8, a work feeding device 190 extends from the alkaline cleaner spraying chamber 14 to the drying chamber 17 and is provided with the carriage 191 similar to that of the works feeding device 110. The work feeding device 190 moves the works W horizontally intermittently by a stroke under control of pushers 192 provided on the carriage 191. The carriage 191 is moved by a stroke in the direction shown by an arrow F in FIG. 8 by a reciprocating mechanism 193 (a part of which is shown in FIG. 3).

The operation of the cleaning apparatus 10 will be now described.

To-be-quenched members G heated to a predetermined temperature is oil quenched by immersing the members G in quenching oil at a temperature of 150° C. Works W including the members G are introduced into the water chamber 11 and are loaded on the sliding guides 40 of the lifting unit 21. By lowering the lifting unit 21, the works W are immersed in the water bath 20 for a predetermined time. Water at a temperature of 75° C. is contained in the water bath 20. Since the temperature of the works W is not less than 100° C., the water boils on the surfaces of the works W immersed in the water.

Moreover, hot water in the water bath 20 is stirred by hot air Jetted from the air nozzles 26 and hot water sprayed out of the water spraying nozzles 25. Thus, most of the quenching oil is separated from the surfaces of the works W in the water and floats in the vicinity of the water surface in the water bath 20. Water containing the oil in the vicinity of the water surface is caused to overflow and disposed of from the water bath 20. In order to cause the water containing the oil to overflow, the valve 33 may be opened and the water level in the water bath 20 may be raised by driving the pump 31. After the oil has been removed from the water bath 20, the lifting unit 21 is raised to the original height, thereby lifting the works W from the water bath 20.

Figure 13:
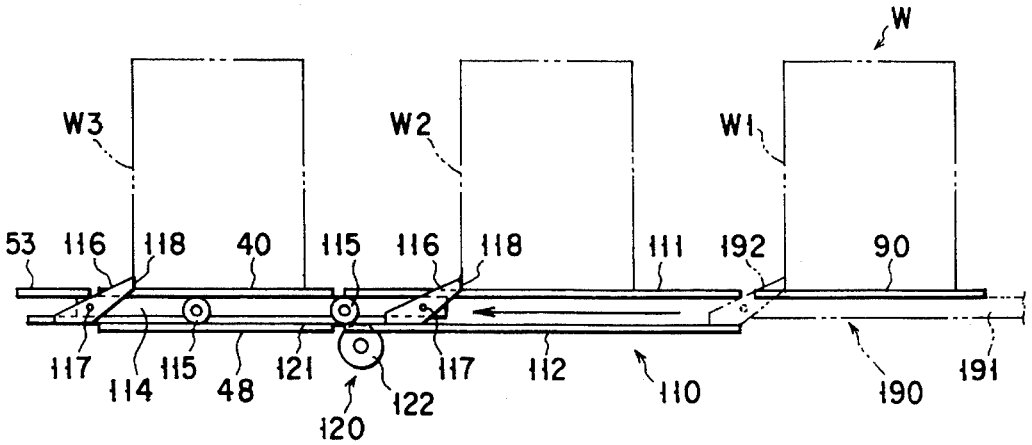
FIG. 13 is a general side view of the carriage of the work feeding device shown in FIG. 11 in a state in which the carriage is retracted.

After the step S1 has been completed, the carriage 114 is retracted by one stroke as shown in FIG. 13. Then, the carriage 114 is advanced again so that the works W are advanced by one stroke as shown in FIG. 14, and the next new works W enter the water chamber 11. At the same time, the works w which were in the water chamber 11 are moved to the water spraying chamber 12.

As the nozzle unit 55 is moved upward and downward, hot water is sprayed on the works W in the water spraying chamber 12 and the surfaces of the works W are cleaned completely. After hot water has been showered for a predetermined time, the works W are supplied to the alkaline cleaner chamber 13 by reciprocating the carriage 114 by one stroke in a similar way to the above-mentioned case. Then, the lifting unit 71 of the alkaline cleaner chamber 13 is lowered, and the works W are inserted in the alkaline cleaner bath 70. In the alkaline cleaner bath 70, the works W are stirred by an alkaline cleaner sprayed out of the nozzles 75. Then, oil is removed from the surfaces of the works W fully, and the works W are cleaned completely. Thereafter, the lifting unit 71 is lifted to the original height.

Since the steps S1 of immersing the works in water and the step S2 of showering water are performed on the works W supplied to the alkaline cleaner chamber 13, almost all oil is removed from the works W, and the amount of the oil brought to the alkaline cleaner bath 70 is very little. Thus, the frequency of exchange of the alkaline cleaner is greatly reduced as compared with the conventional case.

The works W cleaned in the alkaline cleaner bath 70 is sent to the alkaline cleaner spraying chamber 14 by the work feeding device 190. An alkaline cleaner is sprayed from the nozzle unit 140 on the works W in the alkaline cleaner spraying chamber 14. After having been cleaned completely by the alkaline cleaner, the works W are sent to the final spraying chamber 15. In the final spraying chamber 15, the finishing cleaning is performed by spraying hot water on the works W. Then, the works W are sent to the air blowing chamber 16. In the air blowing chamber 16, water drops are blown away from the work W by hot air blown out of the nozzles 172 and 174. Thereafter, the works W are transported to the drying chamber 17 and is dried completely by proper dry hot air or hot wind.

What is claimed is:

1. A cleaning apparatus for cleaning works after immersing the works in an oil bath of a quenching device comprising:

a water chamber having a water bath for containing first water in which works to be cleaned are immersed;

first lifting means provided in said water chamber, having first supporting means for supporting said works and moving said works supported by said first supporting means between a position at which said works are immersed in said first water and a position at which said works are taken out of said first water;

an alkaline cleaner chamber having an alkaline cleaner bath containing an alkaline cleaner in which said works are immersed;

second lifting means provided in said alkaline cleaner chamber, having second supporting means for supporting said works, and moving said works supported by said second supporting means between a position at which said works are immersed in said alkaline cleaner and a position at which said works are taken out of said alkaline cleaner;

a water spraying chamber provided between said water chamber and said alkaline cleaner chamber and having means for spraying second water on said works; and a work feeding device provided in the water spraying chamber and comprising:

a horizontally reciprocating carriage; and a driving mechanism for moving said carriage;

said carriage provided with a pusher for moving said works from the water chamber to the water spraying chamber when said works are in said water chamber and another pusher for moving said works from water spraying chamber to said alkaline cleaner chamber when said works are in said water spraying chamber.

2. A cleaning apparatus according to claim 1, further comprising heating means for heating said first water used in said water chamber to a temperature between 60° C. to 80° C.

3. A cleaning apparatus according to claim 2, further including overflowing means for causing said first water to overflow from said water bath, said overflowing means comprising a water tank for storing said first water heated to a temperature between 60° C. and 80° C., a connecting pipe for connecting said water tank to said water bath, a valve provided on said connecting pipe, and a pump for supplying said first water from said water tank to said water bath.

4. A cleaning apparatus according to claim 1, further comprising heating means for heating said alkaline cleaner used in said alkaline cleaner chamber to a temperature between 60° C. to 80° C.

5. A cleaning apparatus according to claim 1, further comprising heating means for heating said second water used in said water spraying chamber to a temperature between 60° C. to 80° C.

6. A cleaning apparatus according to claim 1, wherein each of said pushers is raised to engage rear faces of said works to push said rear faces when said carriage is moved from said water chamber toward said water spraying chamber and falls when said carriage is moved from said water spraying chamber toward said water chamber.

7. A cleaning apparatus according to claim 1, further comprising first heating means for heating said first and second water, and second heating means for heating said alkaline cleaner, at least one of said first an second heating means comprising a heat exchanger for performing heat exchange between quenching oil in the oil bath of the quenching device and at least one of said water and said alkaline cleaner.

8. A method of cleaning works after the works are heated and then quenched by immersing the heated works in a quenching oil comprising utilizing the apparatus as defined in claim 1.

* * * * *